United States Patent [19]

Lemberg

[11] 4,385,215

[45] May 24, 1983

[54] THIN-MEMBRANE SWITCH

[75] Inventor: Milton B. Lemberg, Phoenix, Ariz.

[73] Assignee: EECO Incorporated, Santa Ana, Calif.

[21] Appl. No.: 319,555

[22] Filed: Nov. 9, 1981

[51] Int. Cl.[3] ..... H01H 9/00

[52] U.S. Cl. ..... 200/5 A; 200/86.5; 200/159 B; 200/292

[58] Field of Search ..... 200/5 A, 159 B, 85 R, 200/86 A, 86.5, 292

[56] References Cited

U.S. PATENT DOCUMENTS

| | | | |
|---|---|---|---|
| 3,056,005 | 9/1962 | Larson | 200/86 R |
| 3,383,487 | 5/1968 | Wiener | 200/168 |
| 3,718,791 | 2/1973 | Szablowski | 200/86 R X |
| 3,721,778 | 3/1973 | Seeger et al. | 200/5 R |
| 3,862,381 | 1/1975 | Glaister et al. | 200/5 A |
| 3,969,595 | 7/1976 | Johnson | 200/86 R |
| 4,017,697 | 4/1977 | Larson | 200/5 A |
| 4,066,851 | 1/1978 | White et al. | 200/5 A |
| 4,317,013 | 2/1982 | Larson | 200/5 A |

*Primary Examiner*—R. L. Moses
*Assistant Examiner*—Morris Ginsburg
*Attorney, Agent, or Firm*—Harry R. Lubcke

[57] ABSTRACT

A flexible membrane switch having a thin insulating layer with a plurality of small apertures interposed between two sets of conductors which cross at each aperture. A person's fingertip pressed upon the switch closes the contacts at plural apertures. Spurious contacting is prevented. An alternate has an additional interposed insulating layer except at those areas where fingertip pressure is to be applied. Larger area switches may be palm, fist or foot operated.

10 Claims, 6 Drawing Figures

THIN-MEMBRANE SWITCH

BACKGROUND OF THE INVENTION

This invention pertains to a thin, planar electric switch.

The art has disclosed a variety of planar electric switches of the instrument type, suited to carry currents in the milliampere range. These have included printed circuit board (pcb) switches that employ a stiff board of Formica, or equivalent, and utilize known pcb etching techniques to form conductors.

Pushbuttons have ranged from separate depressable entities to an area below which an open "window" is formed in an insulating layer that separates two printed circuits. These pushbuttons and the windows are typically of fingertip size.

Certain flexible embodiments have been formed by folding over two or three thicknesses of a flexible plastic, upon which conductive traces have been deposited.

BRIEF SUMMARY OF THE INVENTION

The flexible membrane switch of this invention has a thin electrical insulating layer in which there are a plurality of small apertures. This layer is interposed between two sets of conductors, which may be orthogonally related and cross at each small aperture. Alternate embodiments include colinear and coaxial sets of conductors, also mutually contactable at each small aperture.

The switch is actuated by applying simultaneous transverse pressure over an area embracing plural aperatures, as by using one's fingertip.

In an alternate embodiment an additional insulating layer is interposed adjacent to the thin layer, except at those areas where transverse fingertip pressure is applied.

DETAILED DESCRIPTION OF THE PREFERRED EMBODIMENTS

Figure 1:
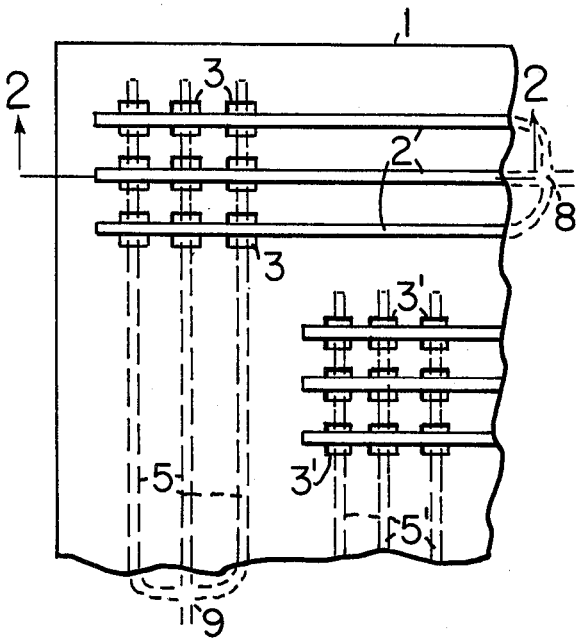
FIG. 1 is a top plan view of an illustrative embodiment of the invention.

In FIG. 1 numeral 1 identifies the top flexible sheet of insulating material. This is preferably a thin film polyester, having the trade name of Mylar or Melinex. It may have a range of thickness of from 0.025 millimeters (mm) to 0.500 mm, with a preferred thickness of 0.125 mm.

Sheet 1 has a conductive configuration printed on the under side. This may take the form of parallel silver strips 2, which are spaced to pass over plural small apertures 3 in a thin central flexible sheet of insulating material 4.

The conductive configuration 2 is printed by employing photographically produced film positives for artwork. A woven mesh fabric of stainless steel or polyester or the like is given a photographic image of the pattern desired. Conductive printing material is then forced through the open areas of the fabric onto the under side of flexible sheet 1, which is in contact with the fabric. This is accomplished by using a squeegee, which may be made of plastic, rubber or metal.

Figure 2:
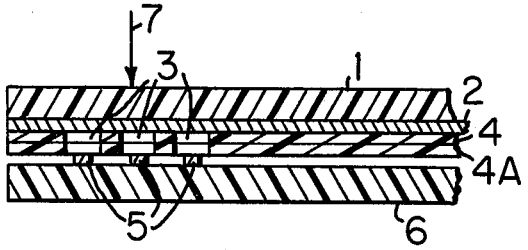
FIG. 2 is an enlarged sectional elevation view of the embodiment of FIG. 1 along line 2—2 in FIG. 1.

In FIG. 2, which shows the structure in section, the vertical scale of the drawing has been increased a number of times to enhance clarity.

Flexible layer 4 may have a thickness within the range of from 0.013 mm to 0.052 mm. This layer is preferably printed onto sheet 1 over conductors 2 according to the printing process outlined above for the conductive configuration. Apertures 3 are formed in the process, typically sized to be about 1 mm across. A square shape is shown in FIG. 1. However, the shape may be circular, oval, trapezoidal, or rectangular for particular functional reasons, or for suitability of fabrication, as will be noted in later figures.

A companion layer 4A may be printed onto sheet 6 to give the total thickness desired. This also halves the probability of unwanted aperture faults in manufacture.

A second differently configured conductors 5 are similarly printed upon the inner surface of second flexible insulator 6. Typically, conductors 5 are configured the same as conductors 2 but are merely orthogonally disposed with respect thereto; also passing centrally with respect to one or more apertures 3.

In the enlarged vertical scale of FIG. 2 it does not appear that fingertip pressure, indicated by arrow 7, would push conductors 2 through apertures 3 in order to contact conductors 5. However, with the vertical exaggerated thickness of FIG. 2 absent, according to the dimensions given herein, contact properly occurs. Also, layer 4A lies upon sheet 6 in FIG. 2 and layer 4 lies upon sheet 6″ in FIG. 4, at locations away from conductors 5 by virtue of the printing process that has been described.

The flexible sheets involved in the structures of this invention are usually transparent. For this reason, conductors 2 and apertures 3 are shown in full lines in FIG. 1. Conductors 5, being further below, are shown in dotted lines, according to a herein evolved convention.

In FIG. 1 a second set of conductors and apertures 3′ are shown at an area removed from the first set of elements. These are illustrative of a second fingertip pressure area for controlling another external circuit or circuits.

These different areas may be identified as printed-on pushbuttons on the top of sheet 1. Further areas beyond the illustrative two shown may be provided almost without limit.

Separate conductors 2 can be connected together at any point away from the active pressure areas, as at 8. Similarly for conductors 5, at 9. In this way, one circuit is closed with nine contacts through nine apertures in parallel when pressure is applied at 7. This increases the current-carrying capacity of the arrangement and also the reliability of contact. In general, a current-carrying capacity of a few milliamperes is sufficient.

FIGS. 1 and 2 are fragmentary. The pattern may be repeated many times elsewhere on the surfaces shown. The surfaces need not be rectilinear as implied by FIG. 1.

Figure 3:
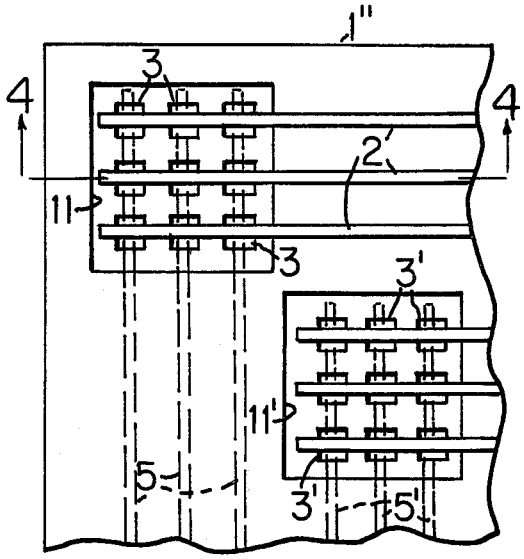
FIG. 3 is a top plan view of an alternate embodiment of the invention, having finger wells.
Figure 4:
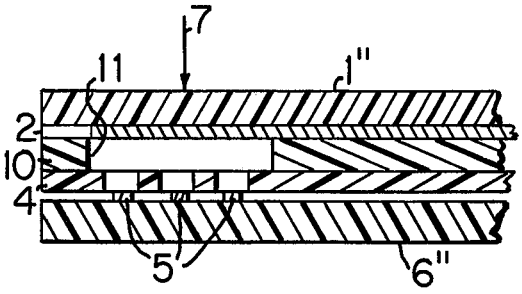
FIG. 4 is an enlarged sectional elevation view of the embodiment of FIG. 3 along line 4—4 in FIG. 3.

FIGS. 3 and 4 show the plan and sectional elevation views of a large aperture alternate embodiment of the invention. This is not the "window" of the prior art. Rather, the structure of FIGS. 1 and 2 is retained, and the inherent operation is the same.

However, an additional internal layer 10, giving four layers in all, is added. This layer has large apertures, as 11 and 11', over the operating thin insulating layer apertures 3 and 3', respectively.

Additional layer 10 is provided to give added reliability to insulating layer 4 at all points away from the operating areas of 3 and 3'. This guards against possible shorts between pairs of conductors, as 2 and 5, due to rough handling of the switch structure as a whole. A layer 10 can be added to the embodiment of FIGS. 1 and 2 away from the operating areas 3 and 3' for this purpose.

Layer 10 can be printed or applied on top layer 1" by repeated printing in the same manner as layer 4 was previously printed. See FIG. 4. In this embodiment layer 4 can be subsequently printed over layer 10, or it can be printed on bottom layer 6".

The large apertures 11, 11', etc. are formed in layer 10 by the screen printing method previously described, or by die cutting a thin plastic insulator and interposing it between layers 2 and 4, or 4 and 4A.

A thickness of layer 10 in the range of from 0.025 mm to 0.500 mm, with a preferred thickness of 0.100 mm, is suitable.

The large apertures 11 merely provide a "well" into which the forefinger enters in operating the switch.

Figure 5:
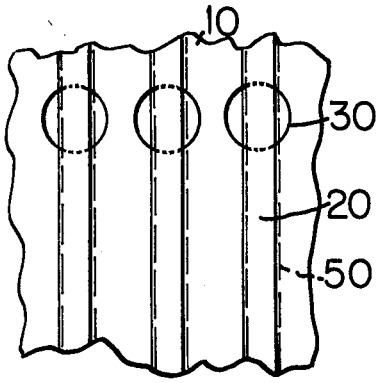
FIG. 5 is an enlarged fragmentary top plan view of an alternate embodiment, having colinear conductive traces.

FIG. 5 shows an alternate embodiment of the switch of FIG. 1, in which the conductors, 20 and 50, are colinearly rather than orthogonally arranged. These conductors are held apart by a thin central flexible sheet of insulating material 4, as in FIG. 2. Apertures 30 in sheet 4 are shown round, which is an alternate effective shape, as is oval.

Conductors 20 and 50 may also be arranged at any angle, one to the other. Apertures 30 are located at the intersections of conductors 20 with conductors 50.

Figure 6:
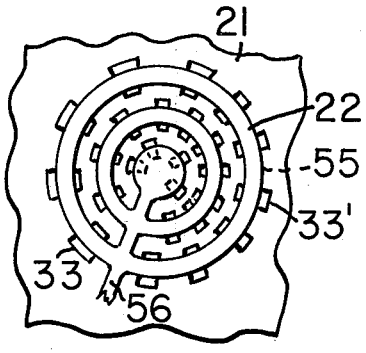
FIG. 6 is an enlarged fragmentary top plan view of a further alternate embodiment, having concentric conductive traces.

FIG. 6, shows a further alternate embodiment, in which 21 is the first flexible insulator and conductors 22 and 55 are arranged in concentric rings. These are held apart by sheet 4, as before. Apertures 33 therein have a trapezoidal shape; or may have a rectangular shape, as at 33'. In FIG. 6 conductors 55 lie directly below conductors 22. Finger pressure upon the whole coaxial configuration gives electrical contact between conductors 22 and 55 through the several apertures, as 33 and 33'.

Further radially positioned conductor 56 electrically joins concentric rings 22. An equivalent conductor (not shown in FIG. 6) joins concentric rings 55. In this way one switch is formed. For another switch this configuration is repeated elsewhere on the whole switch structure. Also, by forming conductor 56 in contact with only the two inner rings and providing another radial conductor for the outer ring a two-pole switch is created.

Each of the switches is assembled by printing-on a printable adhesive, or applying a transfer adhesive, around the periphery beyond the active working areas shown in the figures. This would typically be between layers 4 (or 4A) and 6 in FIG. 2, and between layers 10 and 4 in FIG. 4. Additionally, further sealant can be applied along the whole peripheral edge of the sandwich structure.

It will be understood that a large switch having many apertures 3 and an area equal to that of the palm of a hand, or of a fist, can be fabricated. Such switches are typically formed with hundreds of apertures 3 and substantially an equal number of contacts are made by pressure from a palm or fist.

Such large switches may be used for safety or panic purposes. Also, such a switch may be used as a floor mat, where pressure 7 exerted by a foot closes the electrical circuit.

These many contacts switches may carry a total current in the ampere range, rather than in the milliampere range. Also, by employing high conductivity silver conductors 2 and 5 and increased aperture size 3, a nominal number of contacts will carry current in the ampere range.

Pressure 7, in FIG. 2 and elsewhere, can be exerted by mechanical as well as human means like a fingertip. The mechanical arrangement may be any sort of a plunger. This may be magnetically operated, as with a solenoid coil surrounding it, or by hydraulic or pneumatic actuators.

I claim:

1. An electric switch having planar elements, comprising:

(a) a first configured conductor (2) printed upon the inner surface of a first flexible insulator (1), (b) a second conductor (5) printed upon the inner surface of a second flexible insulator, configured to intersect said first configured conductor at a plurality of locations, and (c) a third incompressible flexible insulator (4) disposed between said first and second configured conductors, said third flexible insulator printed upon at least one of said first or second flexible insulators and having an aperture at each of said plurality of locations, to allow electrical contact between the first and second conductors at plural locations upon application of transverse pressure upon the switch over an area embracing plural locations.

2. The switch of claim 1, in which;

(a) said first and second configured conductors are substantially linearly orthogonally related.

3. The switch of claim 1, in which;

(a) said first and second configured conductors are substantially annularly related.

4. The switch of claim 1, in which;

(a) said first and second configured conductors are substantially colinearly related.

5. The switch of claim 1, in which;

(a) said third flexible insulator is printed upon both said first (1) and second (6) flexible insulators and the printing of said third flexible insulator have coincident apertures.

6. The switch of claim 1, in which;

(a) the recited conductor-insulator-aperture structure is duplicated at plural separate areas over the total area of said switch.

7. The switch of claim 1, in which;

(a) the recited conductor-insulator-aperture structure is duplicated to embrace a large area, as that of the palm of a hand.

8. The switch of claim 1, in which;

(a) said first and second configured conductors have plural separate configurations that separately pass over plural said apertures in the third insulator, and (b) said plural separate configurations of the first conductor are elsewhere electrically connected together (8), and said plural separate configurations of the second conductor are elsewhere electrically connected together (9), to provide contact between the first and second conductors at plural aperture locations, upon transverse pressure being applied at the plural aperture locations.

9. The switch of claim 1, which additionally includes;

(a) a fourth flexible insulator (10) interposed between said third flexible insulator and a said configured conductor, save at said plural locations where said transverse pressure is applied.

10. The switch of claim 9, in which;

(a) said plural locations where said transverse pressure is applied embrace a small area, as that of a fingertip.

* * * * *